US006164074A

United States Patent [19]

Madden et al.

[11] Patent Number: 6,164,074

[45] Date of Patent: Dec. 26, 2000

[54] COMBUSTOR BULKHEAD WITH IMPROVED COOLING AND AIR RECIRCULATION ZONE

[75] Inventors: Thomas J. Madden, Vernon; Richard S. Tuthill, Bolton; Harold M. Craig, Winchester Center, all of Conn.

[73] Assignee: United Technologies Corporation, Hartford, Conn.

[21] Appl. No.: 08/989,439

[22] Filed: Dec. 12, 1997

[51] Int. Cl.[7] ..... F23R 3/06; F23R 3/14

[52] U.S. Cl. ..... 60/752; 60/756; 60/750

[58] Field of Search ..... 60/748, 750, 752, 60/755, 756, 757

[56] References Cited

U.S. PATENT DOCUMENTS

| | | | |
|---|---|---|---|
| 2,974,485 | 3/1961 | Schiefer . | |
| 3,831,854 | 8/1974 | Sato et al. | 60/756 |
| 3,853,273 | 12/1974 | Bahr et al. . | |
| 3,901,446 | 8/1975 | Petreikis, Jr. et al. . | |
| 3,916,619 | 11/1975 | Masai et al. | 60/756 |
| 4,085,580 | 4/1978 | Slattery . | |
| 4,180,974 | 1/1980 | Stenger et al. . | |
| 4,191,011 | 3/1980 | Sweeney et al. . | |
| 4,380,905 | 4/1983 | Smart et al. . | |
| 4,392,355 | 7/1983 | Verdouw . | |
| 4,441,323 | 4/1984 | Colley . | |
| 4,586,894 | 5/1986 | Wunning . | |
| 4,686,823 | 8/1987 | Coburn et al. | 60/740 |
| 4,773,596 | 9/1988 | Wright et al. | 60/748 |
| 4,870,818 | 10/1989 | Suliga | 60/756 |
| 4,914,918 | 4/1990 | Sullivan | 60/756 |
| 5,129,321 | 7/1992 | Becker et al. | 60/756 |
| 5,419,115 | 5/1995 | Butler et al. . | |
| 5,490,389 | 2/1996 | Harrison et al. | 60/756 |
| 5,524,438 | 6/1996 | Johnson et al. . | |
| 5,647,215 | 7/1997 | Sharifi et al. . | |
| 5,737,921 | 4/1998 | Jones et al. | 60/748 |

FOREIGN PATENT DOCUMENTS

| | | | |
|---|---|---|---|
| 893018 | 4/1962 | United Kingdom | 60/756 |

*Primary Examiner*—Ted Kim

[57] ABSTRACT

An improved combustor bulkhead 70 for a gas turbine engine 10 includes a plurality of holes 72 and baffles 90 which directs cooling air radially inward around a fuel injector to set up and shape a toroidal recirculation zone 114 surrounding the fuel injector vortex 116 and suppress smoke and carbon formation in the combustion chamber. Various construction details are described to provide an aerodynamically superior bulkhead design.

3 Claims, 3 Drawing Sheets

COMBUSTOR BULKHEAD WITH IMPROVED COOLING AND AIR RECIRCULATION ZONE

TECHNICAL FIELD

This invention relates generally to gas turbine engine combustors and more specifically to improved combustor bulkheads therefor.

BACKGROUND ART

Axial flow gas turbine engines are used to power modern aircraft. These gas turbine engines typically include a compressor section, a combustion section, and a turbine section. A flow path for working medium gases extends axially through the sections of the engine.

As the gases flow along the flow path, the working medium gases are compressed in the compressor section. The working medium gases then flow to the combustion section where they are mixed with fuel. The gases and fuel are burned to add energy to the gases. The gases are expanded through the turbine section to produce useful work to power the compression section and, in case of aircraft engines, to power the aircraft.

Typically, the combustion section includes combustion chambers wherein air compressed by the engine's compressor, is mixed with fuel sprayed into the combustion chambers by fuel nozzles which extend into the combustion chambers. Each combustion chamber includes a bulkhead at the upstream end and a combustion zone axially downstream of the bulkhead. The bulkhead has a plurality of openings to accommodate the extension of fuel nozzles into the combustion chamber. The fuel-air mixture in the combustion zone flows in a whirling flow or vortex pattern as it moves axially downstream further into the combustion chambers.

It will be appreciated that the environment within a gas turbine engine combustion chamber is extremely harsh. The fuel-air mixture burns in the combustion chamber at temperatures as high as 2700° C. (4500° F.) causing extreme thermal gradients and therefore, thermal stresses in the combustion chamber walls. Air is introduced in the combustion chamber to support the fuel combustion process and to cool the combustion chamber in order to relieve thermal stresses. The bulkhead area is one region that requires cooling air because of the heat generated by the introduction and ignition of the fuel-air mixture proximate thereto. Various schemes have been employed to supply cooling air to this area. Typically, air is bled from the compressor to provide the cooling air to the combustion section.

In the prior art, bulkhead cooling air is discharged into the combustion chambers from several bulkhead locations. One portion of the cooling air enters the chamber through standoffs between the bulkhead and the fuel nozzle guides. This portion of cooling air enters the combustion zone and mixes with the fuel-air vortex injected by the fuel nozzles. Another portion of the bulkhead cooling air flows radially outwardly into the combustion chamber proximate to the combustion chamber liners and away from the fuel nozzles. The amount of cooling air entering these prior art combustion chambers through the different locations varies depending on local conditions such as pressures, temperatures and fuel-air mixture. This variability of cooling air entering the combustion process provides for unoptimized and unpredictable combustion.

The introduction of cooling air into the combustion chamber necessarily affects the combustion process or combustion stoichiometry by supplying some of the air (oxygen) to burn the fuel and by guiding the location of flames inherent in the combustion process. For reasons of combustor performance and durability, a primary flame axially downstream of the fuel nozzle is desired. The cooling air, being oxygen rich, may produce undesirable secondary flames at any point after introduction into the fuel rich zone downstream of the fuel nozzles. The local conditions, such as pressures, temperatures, may be able to extinguish these secondary flames. Therefore, the amount of cooling air, the point of its introduction and capability to mix with the fuel-air mixture injected by the fuel injectors, are important in the design of a gas turbine engine combustion chamber.

Due to extreme turbulent and thermodynamic conditions inherent in the combustion chambers, there are localized low pressure areas present near the bulkhead. The localized low pressure areas are prone to the generation of local eddies or swirlings pattern flow of fuel-air mixture introduced by the fuel nozzles. As a result, the localized eddies of the fuel-air mixture proximate to the bulkhead increases the temperature of the bulkhead. The eddies of fuel-air mixture may ignite causing secondary flames which may damage the bulkhead and associated fuel nozzle guides or combustion chamber walls. Even if the eddies do not ignite, they interfere with the axial flow of the fuel-air vortex downstream of the bulkhead. The eddies detract from the creation of useful heat as they trap portions of the fuel-air mixture proximate to the bulkhead depleting the fuel-air vortex of useful energy.

In order to prevent the continuous bathing of the fuel nozzles and bulkhead surfaces with the hot fuel-air mixture eddies, it is important to maintain the conical shape of the fuel-air vortex and to urge the flow of this vortex away from the metal surfaces of the bulkhead and associated structures. Prior art combustion chambers utilize compressor air added directly at the fuel nozzle tip, through dedicated openings to encourage the fuel-air vortex to remain conical as it exits the fuel nozzle to maintain proper fuel-air mixture proportions.

Further, the localized eddies of fuel-air mixture increase the overall temperature of the combustion chamber and thus, may produce unacceptably high levels of Nitrous Oxide (NOx). Efforts to reduce the amount of cooling air are effective in reducing NOx emissions but often cause unacceptable levels of carbon and soot (smoke) formation. The trade between NOx levels and smoke has been a longstanding problem in prior art combustion chambers.

DISCLOSURE OF THE INVENTION

It is therefore, a principle object of the present invention to provide an improved combustor bulkhead for a gas turbine engine, which efficiently controls and uses cooling air and improves combustion performance.

In accordance with the present invention, a combustor for a gas turbine engine includes a bulkhead for receiving fuel nozzles, with dedicated cooling holes and baffles. The baffles are mounted downstream of the bulkhead such that as cooling air flows through the bulkhead holes, it impinges on the baffle. The warmed (from bulkhead is heat absorption) cooling air then flows towards the center of the baffles and at the fuel nozzles. As the warmed cooling air flows inwardly toward the fuel nozzles and enters into the interior of combustion chamber, the cooling air entrains combustion products from the vicinity of the bulkhead, helps shape and reinforce a recirculation zone surrounding the fuel-air vortex created by the fuel nozzle efflux and serves to maintain the conical shape of this vortex. The recirculation zones created by the efflux of cooling air into the combustion chambers is toroidal in shape. This introduction of the cooling air into the recirculation zones near the fuel nozzles urges the fuel-air vortex to flow axially away from the bulkhead and into the combustion zone. The fuel-air mixture will then remain in the combustion zone for a sufficient length of time to complete combustion. Thus, levels of nitrous oxide, carbon and smoke formation are minimized. Further, the introduction of cooling air proximate to the fuel nozzles eliminates the potential for bathing the metallic surfaces of the bulkhead and associated structures with the hot fuel-air mixture eddies which could result in excessive metal temperatures leading to combustor durability problems.

Thus, the primary advantage of the present invention bulkhead is the efficient use of the cooling air to provide cooling for the bulkhead surfaces, and to maintain the conical shape of the fuel-air mixture introduced by the fuel-nozzles. The cooling air guides the flow of the fuel-air mixture away from the bulkhead and associated fuel nozzle structures, thereby resulting in a durable bulkhead. Due to its points of introduction, the cooling air also minimizes smoke and carbon formation in the combustion chamber. Further, the present invention is cost effective to manufacture due to its simplicity. The present invention design eliminates the need to provide for separate openings for additional cooling air near the fuel-nozzle tip for smoke control.

The foregoing and other objects, features and advantages of the present invention will become more apparent in the light of the following detailed description of the best mode for carrying out the invention and from the accompanying drawings which illustrate an embodiment of the invention.

BEST MODE FOR CARRYING OUT THE INVENTION

Figure 1:
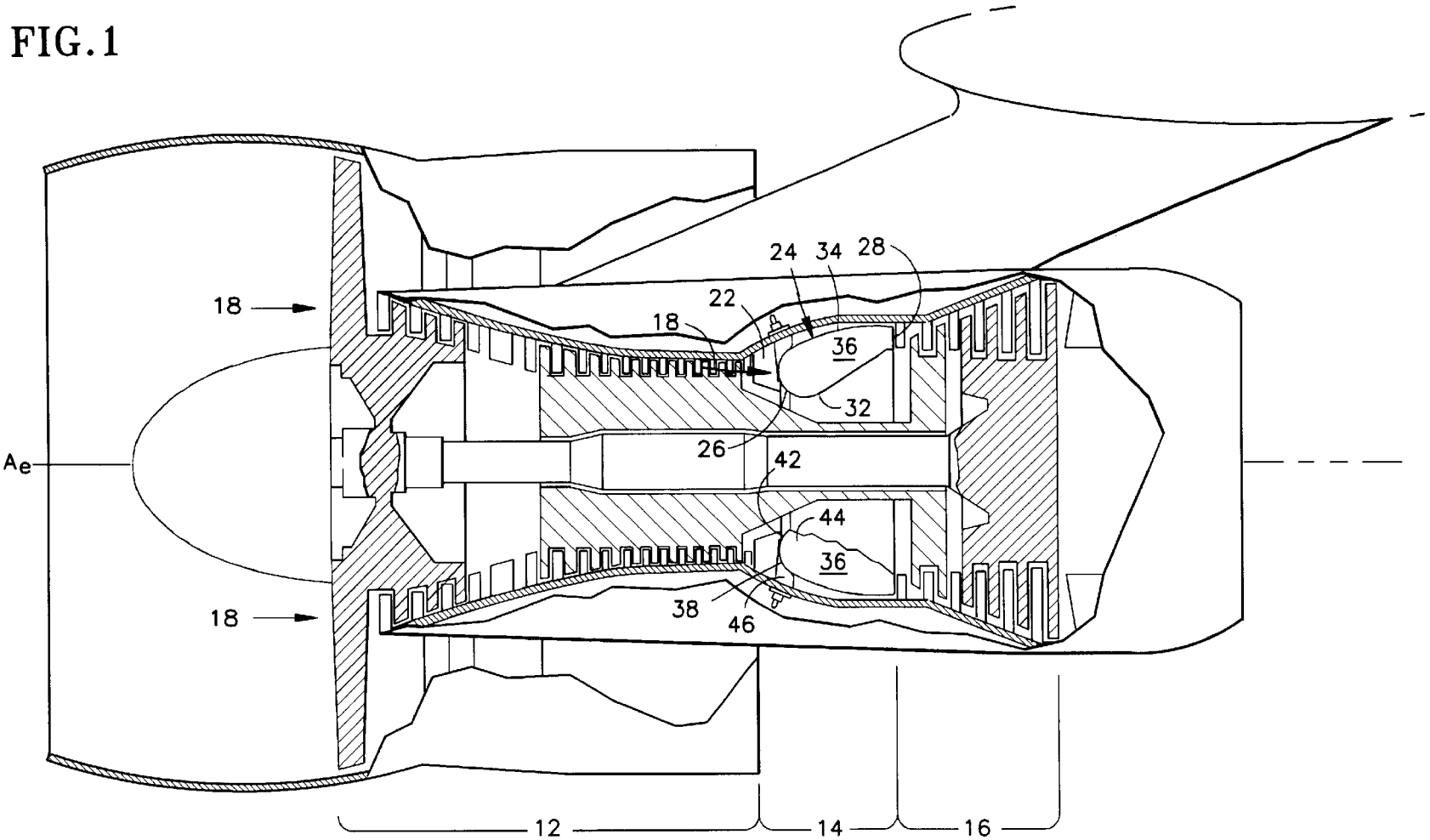
FIG. 1 is a schematic of a side elevation of a power plant such as a gas turbine engine.

Referring to FIG. 1, the engine 10 includes a compression section 12, a combustion section 14, and a turbine section 16. The sections are disposed along axis $A_e$ of the engine. A flow path for working medium gases 18 extends axially through these sections of the engine.

The combustion section includes a plenum 22 for air which is received from the compression section. An annular combustion chamber 24 is disposed in the plenum. The combustion chamber has an upstream end 26 and a downstream end 28.

The combustion chamber 24 includes an inner liner 32 which extends circumferentially about the axis $A_e$ of the engine. An outer liner 34 is spaced radially from the inner liner leaving an annular combustion zone 36 therebetween. The combustion zone is disposed between the upstream end and the downstream end.

The combustion chamber 24 includes a combustor head 38 at the upstream end of the combustion chamber. The combustor head includes a circumferentially extending dome 42 and a radially extending bulkhead (not shown) which is spaced axially from the dome, leaving a supply region 44 for supplying air to the combustion zone. A plurality of fuel nozzles 46 are spaced circumferentially about the interior of the combustion chamber. Each fuel nozzle extends into the combustor head and through the bulkhead to deliver fuel to the combustion zone on the interior of the combustion chamber.

Figure 2:
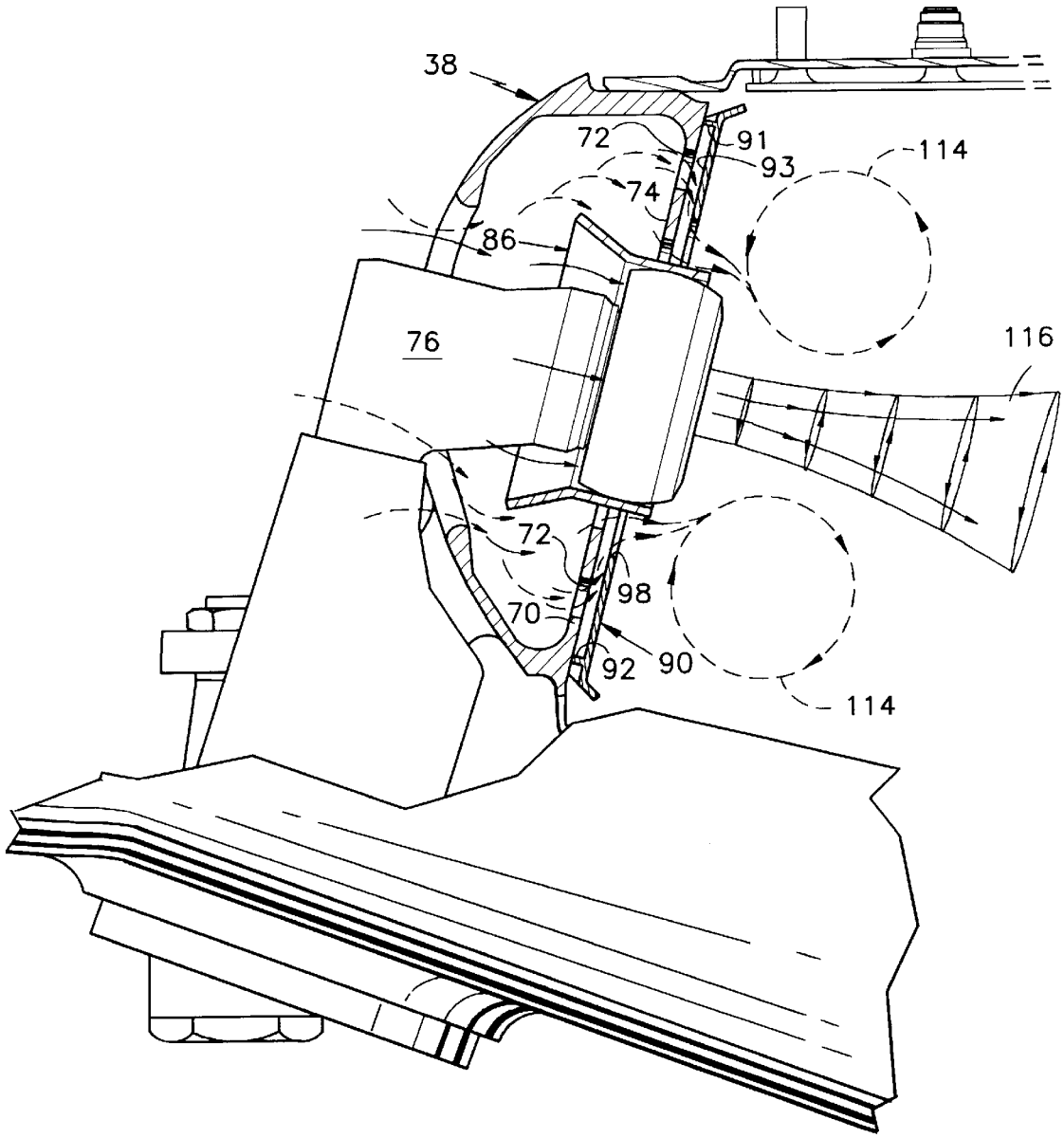
FIG. 2 is a side elevation of a portion of the combustion chamber shown in FIG. 1 incorporating the bulkhead of the present invention.
Figure 3:
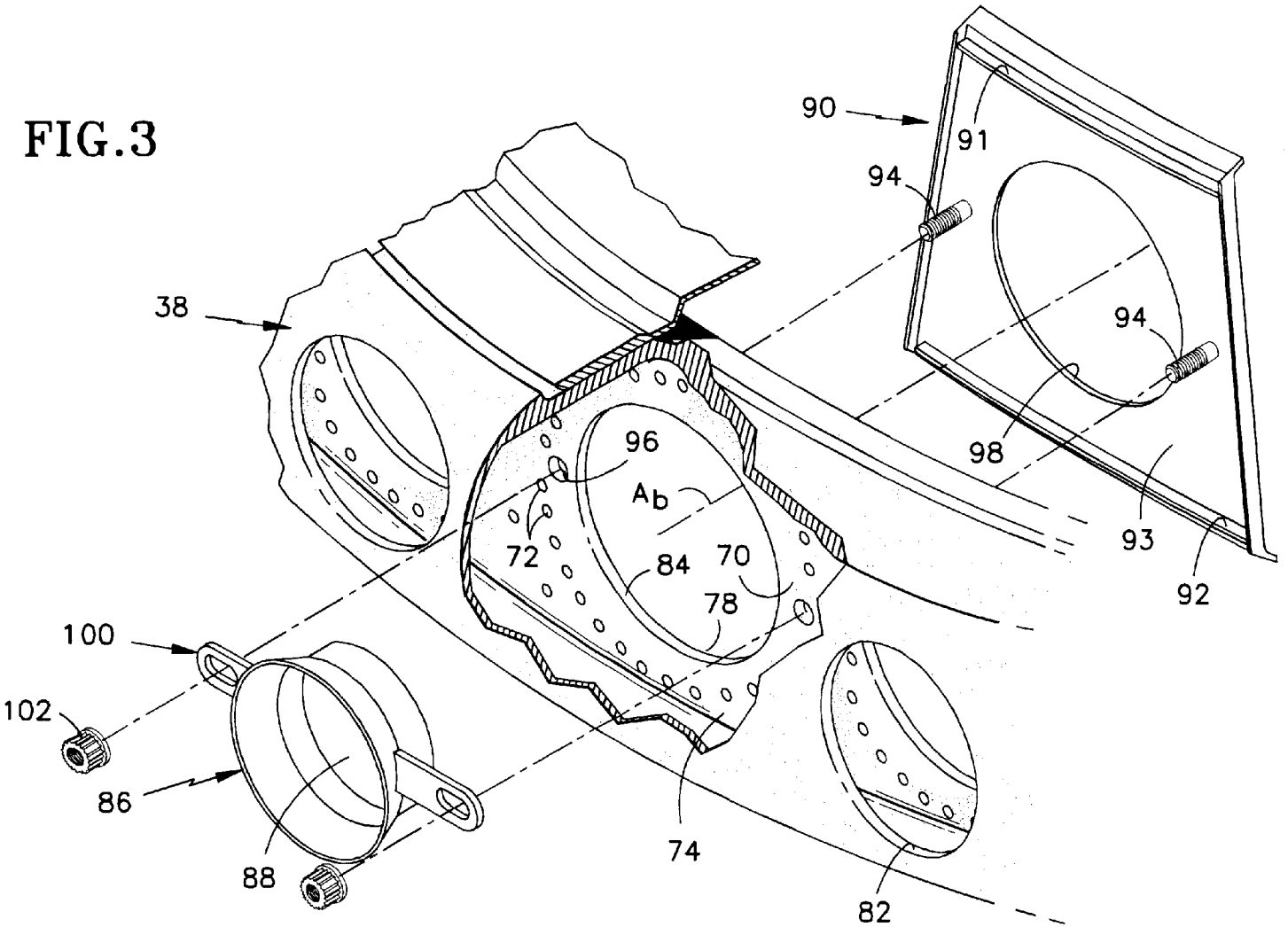
FIG. 3 is an exploded view of a portion of the combustion chamber showing the relationship of a fuel nozzle guide and a baffle to the bulkhead of the present invention.

Referring to FIGS. 2 and 3, a portion of the combustion chamber including the bulkhead 70 of the present invention having a plurality of holes 72 in the upstream surface 74 of the bulkhead is shown. These holes 72 serve as airflow passages.

Referring to FIG. 3, the combustor is partially broken away to show the relationship of several components which are disposed adjacent to each fuel nozzle 76 and which supply cooling air to the region adjacent the bulkhead 70. The combustor has a plurality of circumferentially spaced openings 82 in the dome and openings 84 in the bulkhead. The openings in the bulkhead are axially aligned with the openings in the dome for accommodating the insertion of the fuel nozzles into the combustion chamber. Each opening in the bulkhead has an axis $A_b$ and the bulkhead has an upstream surface 74 and a downstream surface 78.

A plurality of fuel nozzle guides, as represented by the fuel nozzle guide 86, are disposed in associated openings in the bulkhead 70. Each guide has an axially extending hole 88 through the guide which accommodates an associated fuel nozzle 46.

A plurality of baffles 90 are disposed about the interior of the combustion chamber. Each baffle abuts circumferentially the adjacent baffles to form a baffle assembly. The baffle assembly extends about the interior of the combustion chamber downstream of the bulkhead. The baffle includes rails 91, 92 in the inner and outer diameter and a plate 93. The plate has two studs 94 extending axially from the plate. The studs extend through corresponding holes in the bulkhead as represented by the hole 96 shown. The plate 93 has a hole 98 for receiving the fuel nozzle guide 86. A fuel nozzle guide retainer 100 is disposed on the upstream side of the bulkhead 70. Fasteners, such as the nuts 102, are attached to the studs 94 to securely attach the baffle 90 to the bulkhead 70 with the plate 93 of the baffle being urged against the bulkhead by the fasteners.

During operation of the engine, cooling air flows through the plurality of holes 72 in the bulkhead and into the space between the bulkhead and the baffle 90. From there on, the warmed (from bulkhead heat absorption) cooling air is urged radially inwardly by the baffle to flow towards each fuel nozzle guide 86. The rails 91, 92 prevent the flow of the cooling air radially outwardly into the combustion zone. The warm cooling air is directed toward the fuel nozzle injectors 76 via the large round hole 98 in each baffle which allows for the efflux of the cooling air. The cooling air entrains combustion products from the vicinity of the bulkhead and helps shape a toroidal recirculation zone 114 surrounding the fuel-air vortex 116 created by the fuel nozzle efflux. Some of the cooling air may also be entrained in the fuel-air vortex. The toroidal recirculation zones on the sides of a fuel-air vortex serve to maintain the conical shape of the vortex. By maintaining a conical shape of the fuel-air vortex, the recirculation zones guide the combustion process away from the metallic surfaces of the bulkhead. This keeps the bulkhead surfaces from being bathed by hot combustion products and reduces associated thermal stresses.

Further, the introduction of the cooling air into the toroidal recirculation zone near the fuel nozzles minimizes the emissions level by facilitating improved mixing of the fuel and air which in turn improves combustor performance and emissions. The toroidal recirculation zone urges the fuel-air mixture to remain in the combustion zone for a sufficient length of time to bring them to an optimum ignition temperature in order to complete combustion. Failure to maintain the fuel-air mixture in the combustion zone for a sufficient period of time is a prime cause of incomplete combustion and smoke.

A significant advantage of the present invention is its mechanical simplicity which also results in it being aerodynamically superior to prior art combustors. In the present invention, the external cooling air is used not only to cool the bulkhead but also to improve combustion performance. The cooling air helps shape and reinforces the toroidal recirculation zones surrounding the fuel injection vortices. As a result, the conical shape of the fuel injection vortices is maintained which assists in facilitating complete combustion. The aerodynamics of the toroidal recirculation zones prevents the creation of local eddies of high temperature fuel-air mixture near the metallic surfaces of the combustor, in particular, near the bulkhead and fuel nozzle guide surfaces. Thus, one particular advantage of the present invention is the enhanced durability and longevity of the bulkhead fuel nozzle guides which are not subjected to excessive temperatures due to the aerodynamics provided by the toroidal recirculation zones.

Another advantage of the present invention as mentioned hereinabove is the reduction of smoke and carbon formation in the combustor zone due to the introduction of the cooling air around each fuel injector. The cooling air reduces the carbon and soot formation in the same manner as airflow through the complicated fuel injectors of the prior art which required dedicated holes in the fuel-nozzle tips for introduction of a separate portion of cooling air. Thus, one embodiment of the present invention simplifies the construction of the fuel nozzles as they no longer must accommodate airflow passages near the injector tips.

Although the invention has been shown and described with respect to detailed embodiments thereof, it should be understood by those skilled in the art that various changes in form and detail thereof may be made without departing from the spirit and the scope of the claimed invention.

What is claimed is:

1. A combustor for a gas turbine engine, said combustor comprising a combustion chamber defined at one end thereof by a combustor bulkhead and a combustion zone axially downstream of the combustor bulkhead, said bulkhead including fuel nozzles fixedly mounted within the combustor bulkhead, said bulkhead being prized by:

at least one baffle fixedly mounted to the bulkhead and disposed axially downstream thereof, said baffle being disposed in close proximity to said bulkhead, said combustor bulkhead including a plurality of holes aligned with said baffle such that cooling air introduced in the bulkhead holes impinges upon said baffle and is substantially redirected radially inwardly toward the fuel nozzles and therefrom, axially downstream into the combustion zone wherein the cooling air leaving the bulkhead produces a toroidal recirculation zone which helps shape and urge a combustible fuel-air mixture vortex emanating from said fuel nozzles away from the bulkhead, thereby shielding the bulkhead from hot combustion products and improving emissions by improving airflow, wherein an opening between said baffles and fuel nozzles being of such a size to accommodate efflux of cooling air into the combustion zone.

2. The combustor of claim 1, further characterized by said holes in the combustor bulkhead being of such a size and number to accommodate airflow sufficient for a fuel-air mixture within the combustion chamber which minimizes emissions.

3. The combustor of claim 1, further characterized by the holes in the combustor bulkhead being of such a size and number to accommodate airflow sufficient for cooling said combustor bulkhead structure.

* * * * *